United States Patent [19]

Gentry

[11] Patent Number: 4,696,734

[45] Date of Patent: Sep. 29, 1987

[54] METHOD FOR GAS TREATMENT OF A BED OF PARTICLES

[75] Inventor: Cecil C. Gentry, Bartlesville, Okla.

[73] Assignee: Phillips Petroleum Company, Bartlesville, Okla.

[21] Appl. No.: 856,529

[22] Filed: Apr. 28, 1986

Related U.S. Application Data

[62] Division of Ser. No. 692,457, Jan. 18, 1985, Pat. No. 4,606,138.

[51] Int. Cl.[4] ..... C10G 1/00

[52] U.S. Cl. ..... 208/407; 201/32; 201/36; 202/255; 266/178

[58] Field of Search ..... 208/407, 427, 409, 411; 201/32, 36–38; 202/96, 200, 133–135, 215, 216, 220, 247, 254, 255; 34/182; 110/281, 285, 302; 266/178

[56] References Cited

U.S. PATENT DOCUMENTS

| | | | |
|---|---|---|---|
| 1,690,935 | 11/1928 | Hubmann | 201/34 X |
| 3,179,391 | 4/1965 | Connell | 208/407 X |
| 3,302,936 | 2/1967 | Ban | 263/28 |
| 3,401,922 | 9/1968 | Jones | 414/214 |
| 3,432,348 | 3/1969 | Jones, Jr. | 423/175 X |
| 3,476,649 | 11/1969 | Ledent | 201/31 X |
| 3,483,115 | 12/1969 | Haddad et al. | 208/11 |
| 3,562,143 | 2/1971 | Jagel, Jr. et al. | 208/409 |
| 4,082,645 | 4/1978 | Knight et al. | 208/11 |
| 4,116,810 | 9/1978 | Jones, Jr. et al. | 208/11 |
| 4,133,741 | 1/1979 | Welchman et al. | 208/11 |
| 4,210,491 | 7/1980 | Schulman | 202/135 X |
| 4,402,791 | 9/1983 | Brewer | 202/254 X |
| 4,412,909 | 11/1983 | Faulkner et al. | 208/407 |
| 4,436,588 | 3/1984 | Rammler et al. | 201/31 X |
| 4,464,247 | 8/1984 | Thacker | 202/134 |

*Primary Examiner*—Andrew H. Metz
*Assistant Examiner*—Glenn Caldarola
*Attorney, Agent, or Firm*—William R. Sharp

[57] ABSTRACT

An apparatus and method for gas treating a particle bed wherein a uniform temperature gradient is achieved. A support member, such as a grate, serves to support a bed of particles on a surface thereof. The support member is moved in a predetermined direction. Gas is released from a plurality of positions at different depths in the bed.

6 Claims, 8 Drawing Figures

METHOD FOR GAS TREATMENT OF A BED OF PARTICLES

This is a divisional of application Ser. No. 692,457, filed Jan. 18, 1985, now U.S. Pat No. 4,606,138.

BACKGROUND OF THE INVENTION

In one aspect, this invention relates to an apparatus for gas treating a bed of particles. In another aspect, the invention relates to a method of gas treating a particle bed.

In many alternate fuels processes, heating, drying, retorting, and cooling of solids particles is accomplished by locating the packed solids on a large diameter rotating grate or long, straight conveyor system and by circulating a gaseous medium through the solid bed. A major disadvantage of this type of packed-bed system is that there is a large temperature gradient produced over the bed depth. In order to achieve the desired average bulk solids temperature over the entire bed depth, it is necessary to raise the particle temperature at the upper portion of the bed considerably above te average bulk solids temperature, i.e., often approaching the inlet gas temperature. For oil shale preheating, this can lead to undesirable, premature retorting, and for coal drying, this can produce detrimetal surface cracking and fines generation. To avoid this particle overheating, the inlet gas temperature level must be reduced, thereby reducing packed-bed heat transfer effectiveness. The large temperature gradient also results in longer residence time or moving bed length. An impractically long residence time in a particular heating region or a long bed length is necessitated in prior systems in order to heat the bottom layers in the bed to a level which accomplishes a desired average bulk solids temperature. Long residence times necessarily reduce the efficiency of a gas treatment system. The need to employ long beds requires utilization of very long (i.e. 700–800 ft.) or of large diameter (i.e. 250 ft.) grates which are highly expensive and difficult to properly manipulate.

SUMMARY OF THE INVENTION

It is, therefore, an object of the present invention to provide a particle bed gas treatment apparatus and method which achieves a relatively small temperature gradient over the bed total depth.

It is also an object of the invention to provide a bed gas treatment apparatus and method which requires shorter bed lengths or shorter residence times than prior systems.

The above objects are realized in an apparatus which includes a support member and a means for moving the support member in a predetermined direction. A gas releasing means is provided for releasing a gas from a plurality of positions adjacent a surface of the support member. The positions are located at a plurality of different distances from the support member surface, wherein distance is measured along lines generally normal to the predetermined direction. A bed of particles supported on the support member is accordingly moved in the predetermined direction, gas being released at different depths in the bed.

In another aspect, there is provided by the present invention a method for gas treating a bed of solid particles. The method includes the steps of: moving the bed in a first direction; and releasing the gas into the bed, the gas being released from a plurality of positions at different depths in the bed, wherein depth is measured along lines generally normal to the predetermined direction.

According to one embodiment, the gas is released by a plurality of conduits, wherein each conduit has holes in its sidewall. Holes in each conduit are located at a plurality of different distances from an end of the conduit. Gas is accordingly released into a particle bed through the holes. According to another embodiment, gas is released from a plurality of conduits, wherein each conduit has an open end through which gas is released. The open ends are located at a plurality of different distances from the support member surface.

DETAILED DESCRIPTION OF THE DRAWINGS

Figure 1:
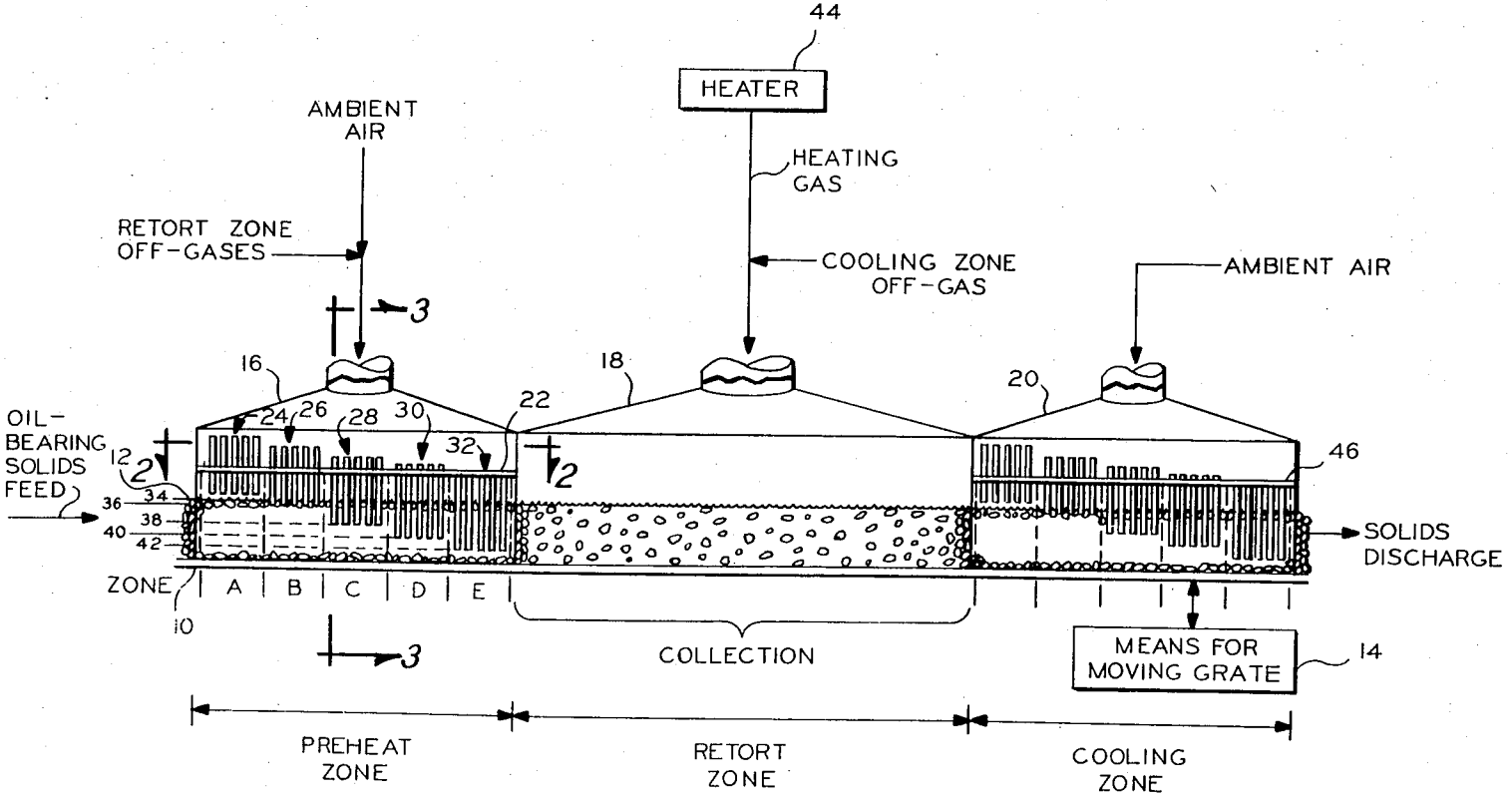
FIG. 1 is a side view of a traveling grate oil shale retort apparatus according to one embodiment of present invention, wherein portions of the apparatus are cut away to show internal details.

Referring now to the drawings, two embodiments of the present invention will be described. It should be appreciated that while the invention will be discussed with reference to the retorting of oil shale, it may be practiced in the recovery of the hydrocarbon fractions from other hydrocarbon-bearing materials, such as coal, tar sands, and the like. Furthermore, the invention could be applied to the gas treatment of any type of particle bed where a uniform temperature distribution through the bed is desirable.

Referring to FIG. 1, a straight grate shale oil retort apparatus is shown. It should be understood that although this embodiment of the invention is shown as utilizing a straight grate for ease of illustration, a circular grate is equally suitable. Grate 10 is of a metallic mesh-like construction such that gases may pass through the grate. As shown, a bed 12 of shale particles is supported on the upper surface of grate 10. Therefore, grate 10 acts as a support member for supporting the shale bed thereon. A suitable means 14 is provided for moving grate 10 in the direction indicated. As will be understood by those skilled in the art, means 14 can comprise a motor, for example, with appropriate gearing etc.

The apparatus shown in FIG. 1 is divided into three zones: a preheat zone; a retort zone; and a cooling zone. Gas plenums or hoods 16, 18, and 20 correspond to each of the above-mentioned zones respectively, and are provided to prevent entry of atmospheric air and to isolate the zones from each other. Although plenums or hoods are shown in FIG. 1 only above grate 10, such plenums might also be provided below grate 10. A side of each illustrated plenum is broken away to show internal details, which include a tube sheet 22 suitably mounted (e.g. welded) within plenum 16 so as to be generally parallel to grate 10. Tube sheet 22 is preferably a metallic plate to provide support for conduits hereinafter described.

Five conduit arrays 24, 26, 28, 30 and 32 are suitably mounted to a tube sheet 22 so as to be oriented generally perpendicular to the tube sheet. Although five arrays are shown in the illustrated embodiment, any number of arrays could be provided according to the present invention as determined by practical engineering limits. Each conduit array comprises a plurality of spaced conduits, preferably made of a steel alloy such as carbon steel, each of which has an upper open end and a lower open end such that gas within plenum 16 may flow through the conduit. In the description of each array which follows, boundary lines 34, 36, 38, 40, and 42 will be referred to, wherein each boundary extends horizontally through different depths in the bed. First considering array 24, each of the conduits in this array extend considerably above tube sheet 22, and extends through tube sheet 22 such that its lower end is immediately adjacent to the upper surface of bed 12. As to array 26, each conduit in this array extends above tube sheet 22 to a lesser degree than conduit in array 24. Furthermore, each conduit in array 26 extends through tube sheet 22 such that its lower open end is embedded in bed 12 and lies along boundary 36. The remaining conduit arrays 28, 30, and 32 are mounted to tube sheet 22 such that the lower open ends of each array lie along boundaries 38, 40 and 42 respectively. Therefore, the conduits in a particular array have open ends located at a particular distance from the grate upper surface. Consequently, conduits in each array extend down to different depths in bed 12, ranging from a 0 depth with respect to array 24 to a depth closely adjacent to grate 10 with respect to array 32. Stated another way, the conduit arrays are arranged in a stepped fashion such that lower open ends for each array are progressively closer in distance to the grate upper surface in a direction parallel to the direction of grate movement. As used herein, distance is measured along lines generally normal to the direction of the grate movement. In addition, the conduit for each array extend above tube sheet 22 to different degrees in order to provide uniform gas flow through the conduits in each array. Also, as shown, each array can be thought of as occupying a particular zone, A, B, C, D, or E in the preheat zone. Retort zone off-gases and also ambient air are introduced to plenum 16 as will be further described in connection with apparatus operation.

A conventional heater 44 is provided to heat an inert or reducing gas which when heated serves as the retorting gas. Cooling zone off-gases (hereinafter described) can be mixed with the heating or retorting gas and introduced into plenum 18. Various conventional collection equipment, schematically shown in FIG. 1, is usually provided to collect hydrocarbon products produced in the retort zone which pass through grate 10. Such collection equipment can be of conventional design and may include, for example, condensers, cyclone separators, scrubbers, electrostatic precipitators, and the like. As to the cooling zone, ambient air is introduced into plenum 20 for the purpose of cooling the particle bed in this zone. A tube sheet 46 and associated conduit arrays are mounted within plenum 20 in a similar manner to that described in connection with the preheat zone.

Although not shown, it would be desirable to provide some sort of gas distributor mechanism in the plenums to evenly distribute gas flow to the various conduits. Also, it might also be desirable to provide gussets mounted between the tube sheet and conduits, or other structural reinforcing means, in view of the force exerted against the conduits by the moving bed.

Figure 2:
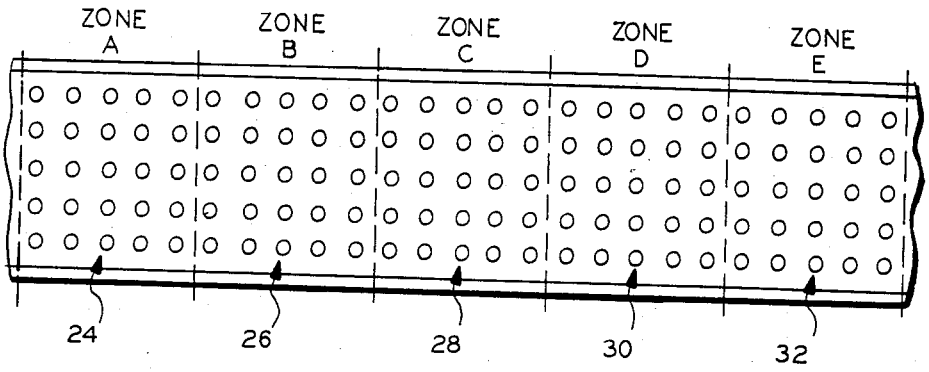
FIG. 2 is a cross-sectional view of a portion of the apparatus of FIG. 1 as viewed along lines 2—2.

Referring now to FIG. 2, the arrangement of the conduits in each array is shown. Spacing of the conduits is primarily determined by the size of the shale particles in the bed. Accordingly, the conduits should be spaced from one another such that the largest particles in the bed can pass between the conduits. Each of the conduits are sized to avoid excessive pressure drops.

Figure 3:
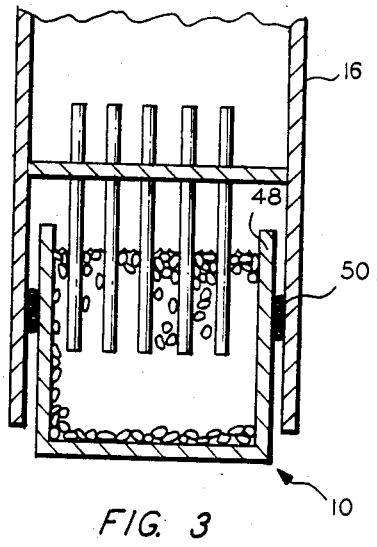
FIG. 3 is a partial cross-sectional view of the FIG. 1 apparatus as viewed along lines 3—3.

Referring to FIG. 3, a different cross-sectional view of the FIG. 1 apparatus is shown which more clearly illustrates the structure of plenum 16 and grate 10. Grate 10 typically includes sidewalls as shown at 48. Sidewalls of plenum 16 extend alongside the grate sidewalls. Some sort of resilient sealing means 50 is also preferably provided between the exterior surfaces of the grate sidewalls and the interior surfaces of the plenum sidewalls.

Although a stepped arrangement of conduit arrays is shown in FIGS. 1–3, it should be understood that the conduits could be arranged such that their ends open into the particle bed in a linear progression. In other words, the conduit ends through which gas is released could be positioned such that each adjacent conduit end lies progressively closer in distance to the grate in the direction of grate movement. Alternatively, the conduit ends could be positioned to progressively increase in distance from the grate surface in the direction of grate movement.

Retorting of shale particles utilizing the apparatus shown in FIGS. 1–3 will now be described. Refined oil shale is first crushed to particle sizes ranging between about ¼ inch and 2 inches, although larger particle sizes may be utilized by varying heating times accordingly. The crushed oil shale particles are loaded upon grate 10 to form bed 12. The depth of the bed may vary anywhere from a few inches to 8 feet or more, but it is most preferably about 4 or 5 feet in depth. The bed is first moved into the preheat zone, wherein off-gases from the retort zone are introduced into plenum 16. These retort off-gases are combustion product gases from the retort zone which can be collected at the bottom of grate 10 in the retort zone. Most preferably, gases entering plenum 16 are at a temperature below 600° F. since cracking of shale starts to occur at temperatures above this level. In the preheat zone it is not desirable for any cracking to occur since hydrocarbon products produced will be lost. If the retort zone off-gases are above this 600° F. limit, ambient air can be mixed with the retort zone off-gases to lower the temperature accordingly. The mixture of preheat gases flows into plenum 16 so as to flow into the upper ends of the various conduits arrays such that gas accordingly flows through the conduit so as to exit the lower open end. As a portion of the bed moves under conduit array 24, the bed layer lying between boundaries 34 and 36, hereinafter denoted as the first layer, is heated to a certain temperature. This temperature will be denoted simply as $T_1$. As the bed proceeds in the indicated direction, a second layer lying between boudaries 36 and 38 is heated to $T_1$ by conduit array 26. The first layer is maintained at approximately $T_1$ while moving through conduit array 26 because of contact between the first layer shale particles and the exterior surfaces of conduits in the conduit array 26. Thus, any tendency for a particular layer to cool down is compensated for by such contact with the hot conduits. A third layer lying between boundaries 38 and 40 is heated to $T_1$ by conduit array 28. The second layer is maintained approximately at $T_1$ by contact with the conduits in conduit array 28. In a similar manner, a fourth layer between boundaries 40 and 42 is heated by conduit array 30 and a fifth layer between boundary 42 and the grate surface is heated to temperature $T_1$ by conduit array 32. Therefore, as the bed proceeds into the retort zone, each of the bed layers have been preheated to a temperature of approximately $T_1$ such that the average bulk solids temperature of the bed equal to $T_1$. In addition, it should be apparent that by preheating the bed utilizing the above described conduit arrays, a relatively uniform temperature distribution is obtained in the bed.

In preheating a shale particle bed, it is typically desirable to preheat the bed to a predetermined average bulk solides temperature. A typical example of such an average bulk solids temperature is about 460° F. As noted above, in prior art systems, preheating gas is released above the particle bed so as to flow through the entire depth of the bed. Considerable residence times or bed lengths are required in such prior systems to reach a desired average bulk solides temperature because of the very large temperature gradient in the bed. By releasing gas at different depths in the bed so as to produce a relatively uniform temperature distribution, the length of the preheat zone or residence time of the bed in the preheat zone required to reach a certain average bulk solids temperature is considerably reduced as compared to prior retorting systems. A shortened preheat zone means that a shorter grate can be used, thereby considerably reducing expense and also simplifying the manipulation of the grate because of less bulk. Or, given a preheat zone of a certain length, a shortened residence time means that more shale can be processed in the retorting apparatus per unit time, thereby increasing efficiency. Moreover, preheating the shale bed according to the present invention avoids the necessity to heat the upper layers of the bed to temperatures at which premature cracking occurs.

The bed of oil shale particles is now moved from the preheat zone to the retort zone wherein heating is accomplished by a cross flow of hot gas. As noted above, a neutral or reducing gas is heated by heater 44 and is passed into plenum 18. If desired, cooling zone off-gases can also be passed into plenum 18. Gases flowing into plenum 18 are preferably at a temperature of about 1000°–1500° F. for the retorting of oil shale. The oil shale particles are heated for a time and temperature sufficient to educe hydrocarbons therefrom. Decomposition of kerogen in the shale particles typically occurs at shale temperatures of about 600° to about 1100° F. Hydrocarbon products produced from retorting pass through grate 10 and are collected accordingly. These products are then usually separated in to various hydrocarbon fractions in a conventional manner. After the particles bed moves through the retort zone, the bed enters the cooling zone. Ambient air is circulated through plenum 20 so as to flow through each of the conduits shown. Gas is accordingly released from the lower open ends of the conduits so as to enter the particle bed at different depths. In a similar manner as discussed in reference to the preheating zone, a uniform temperature distribution is also obtained in the particle bed in the cooling zone. The shale particles are then removed from the traveling grate for further processing or disposal as appropriate.

It should be noted that conduit feeding of gases to the shale bed is not employed in the retort zone of the illustrated apparatus. Conduits will typically not be used in the retort zone because of the very high temperatures. However, conduits as shown in the preheat and cooling zones could be employed in the retort zone if desired, providing the proper materials, structural reinforcements, etc. are employed.

Figure 4:
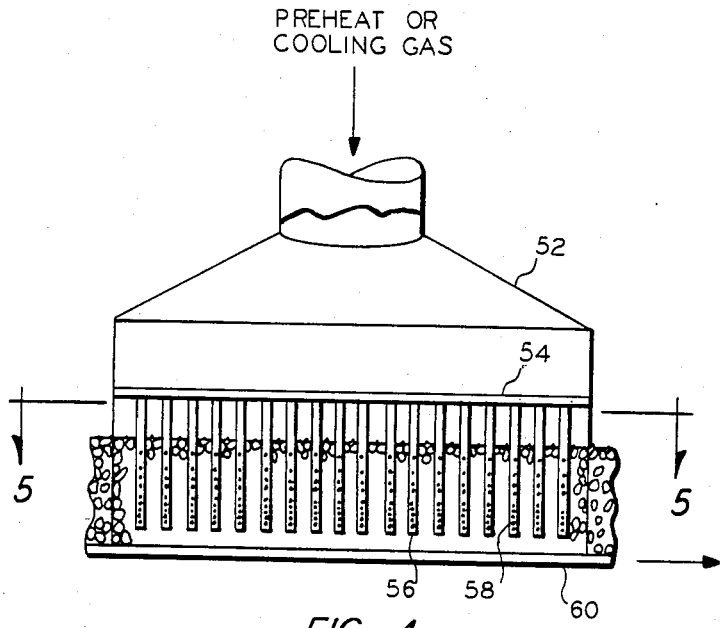
FIG. 4 is a side view of a preheat or cooling zone of a traveling grate retort apparatus according to another embodiment of the invention, wherein a portion of the illustrated apparatus is cut away to show internal details, which include perforated conduits.

Referring now to FIG. 4, a side view of a preheat zone or a cooling zone in a traveling grate apparatus according to a second embodiment is shown. The illustrated apparatus includes a gas plenum 52, a portion of which is cut away to reveal a tube sheet 54 and associated conduits 56 mounted therein. Each conduit 56 has an open upper end mounted to tube sheet 54, the open upper end being in fluid communication with the upper portion of plenum 52. Each conduit 56 has a sidewall, a portion of which has a plurality of holes 58 therein. For a particular conduit, the holes 58 are located at a plurality of different distances from the upper surface of grate 60. As before, distance is measured along lines generally normal to the direction of grate movement. In addition, each of the conduits 56 has longitudinal axis which is generally perpendicular to the direction of grate movement. The lower end of each conduit 56 is preferably capped, and is closely adjacent to the upper surface of grate 60. In operation, preheat or cooling gas is circulated through plenum 52 in a manner similar to that described in reference to FIG. 1, such that gas accordingly flows into the upper end of each conduit 56. Gas then flows down through each conduit and is released from the conduit through holes 58. The conduits and grate 60 are situated with respect to one another such that portions of conduits 56 having holes therein are embedded in the particle bed. In operation, therefore, gas is released from each conduit 56 at different depths in the bed so as to achieve a relatively uniform temperature distribution.

Figure 5:
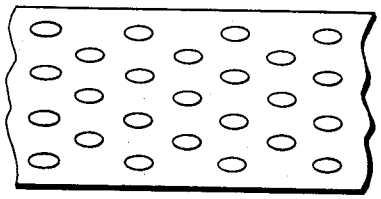
FIG. 5 is a partial cross-sectional view of the FIG. 4 apparatus as viewed along lines 5—5.

Referring now to FIG. 5, this partial cross-sectional view of the FIG. 4 apparatus shows one possible arrangement of conduits 56. As noted with respect to the FIG. 1 embodiment, the conduits should be spaced from one another to allow passage of shale particles thereby. In addition, conduits 56 in the illustrated embodiment are air-foil shaped to allow easy passage of the shale by the conduits. In this regard, the conduits could also be elliptically shaped. Such conduit shapes could also be employed in the FIG. 1 embodiment.

Figure 6:
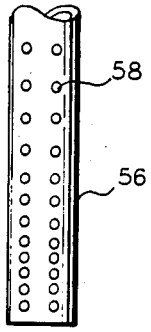
FIG. 6 is a close-up view of one perforated conduit as shown in FIG. 4.
Figure 7:
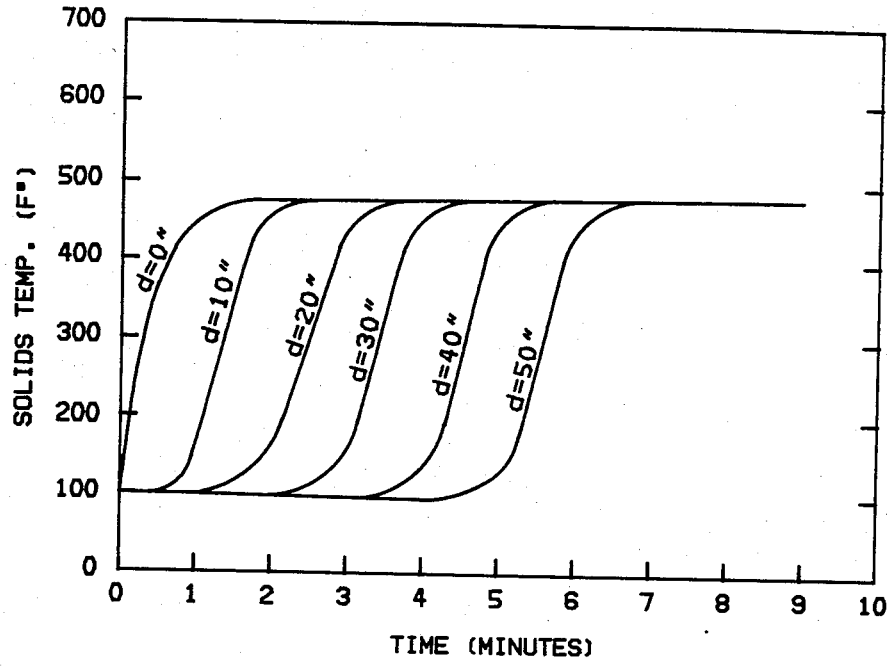
FIG. 7 is a plot of solids temperature versus time for a calculated example employing the embodiment shown in FIGS. 1–3.

Referring now to FIG. 6, a close-up view of a portion of a conduit 56 is shown. In this particular embodiment, several columns (only two of which are shown) of holes are provided around the circumference of the conduit sidewall. The number and size of holes 58 are determined to avoid excessive pressure drops. Preferably, the distance between holes in each column incrementally decreases from the upper end of the column to the lower end of the column so that there are more holes at the lower end of the conduit than at the upper end. More precisely, if the conduit is longitudinally divided into a plurality of sections, for a first section adjacent to a second section being closest to the conduit lower end, the second section includes a greater number of holes than the first section. Such an arrangement of holes in conduit 56 provides for uniform gas flow at all depths in the particle bed.

An example will now be described which should not be construed to limit the invention in any manner. This example was calculated for the preheat zone of a rotating grate shale retorting apparatus utilizing stepped conduit arrays as shown in FIG. 1. Boundary lines like those shown in FIG. 1–34, 36, 38, 40, and 42— are assumed to have the following respective d/L ratios, wherein d is the depth to a boundary line and L is the total depth of the bed: 0; 0.2; 0.4, 0.6; and 0.8. Summarized below are rotating grate and particle bed dimensions:

Particle size=0.55 in=0.458 ft
Grate O.D.=246.8 ft
Grate I.D.=218.8 ft
Grate Width=14 ft
Bed Depth=50 in
Total Cycle Time=90 mins
Preheat Time=10 mins
Grate Rotational Speed=0.01111 rev/min or 8.125 gt/min (at center of grate)
Bed Void Fraction=0.476
Particle Surface Per Unit Volume=68.54 $ft^2/ft^3$
Process conditions are assumed to be as follows:
Initial Shale Temperature=77° F.
Gas Inlet Temperature=600° F.
Gas Inlet Mass Velocity=1404 $lbs/hr.ft^2$
Inlet Gas Density=0.0381 $lbs/ft^3$ (at 600° F.)
Inlet Gas Superficial Velocity=10.24 ft/sec (at 600° F.)
Maximun Solids Temperature=600° F.

Using the data above, a solids temperature history was calculated utilizing the Schumann-Furnass model (see Schumann, T.E.W., Journal of Franklin Inst., Vol. 208, pp. 305–316, 1929 and Furnass, C.C. Trans ALCHE Vol. XXIV, pp. 142–193, 1930). This temperature history is plotted for the rotating grate preheat zone in FIG. 7, wherein solids temperature is plotted versus time. In the graph, d represents bed depth. A curve is plotted for various bed depths ranging from 10 to 50 inches. It can be seen from the graph, that at d=0, or at the upper surface of the bed, the temperature increases rapidly to about 460° F. upon exposure to gas released from a conduit array similar to array 24 in FIG. 1. At d=10", the temperature also increases to about 460° F. upon exposure to a conduit array similar to array 26 in FIG. 1. In a similar manner, gas is released by the different arrays at different depths to successively heat each bed layer to about 460° F. Thus, after each layer in the bed is exposed to gas released from its corresponding conduit array, the temperature within the bed is substantially uniform. Thus, in this calculated example, the average bulk solids temperature achieved in preheating is about 460° F. This temperature, as is apparent from the graph, is reached at a residence time of 6.5 mins. Note also that this desired average bulk solids temperature is obtained without any bed layer reaching the gas inlet temperature of 600° F., thereby avoiding any premature cracking.

Figure 8:
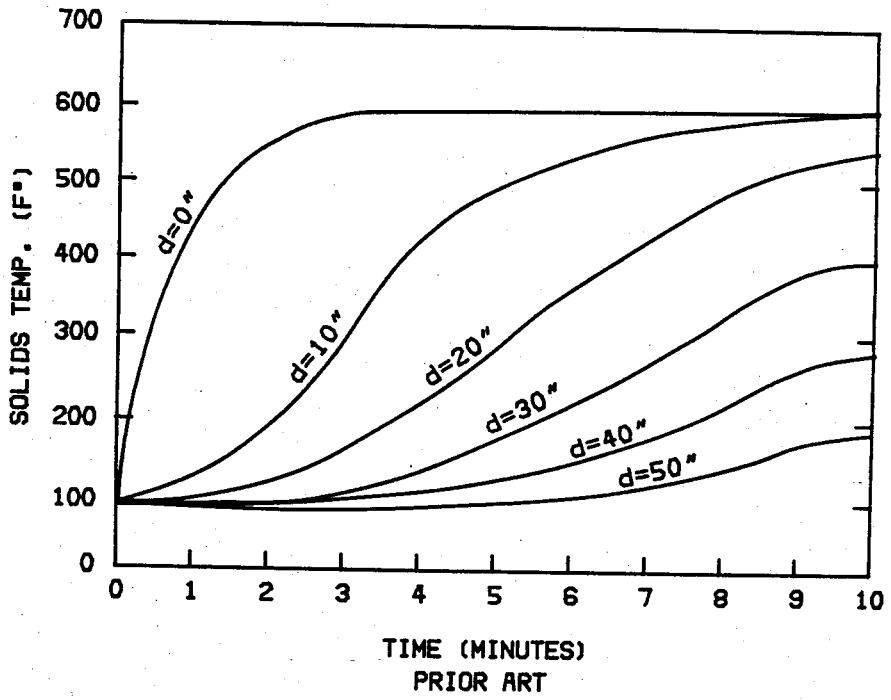
FIG. 8 is a plot of solids temperature versus time as calculated for a prior art shale retorting system preheat zone.

Referring now to FIG. 8, a calculated solids temperature history is plotted utilizing the same dimensions and process conditions for a prior art apparatus wherein all preheat gas is introduced into the bed at its upper surface. At d=0, the bed reaches a temperature equal to the gas inlet temperature of 600° F. in only a few minutes. At d=10", the bed temperature approaches this inlet temperature. At such a temperature of nearly 600° F., premature cracking starts to occur in the preheat zone. Hydrocarbon products produced from such cracking are not collected and are therefore lost. At deeper depths of d=40" or 50", it can be seen that temperature rises very slowly to only around 200° F. at 10 mins. It is necessary in such a prior art system to raise the temperature of the bed upper surface considerably above the desired average bulk solids temperature, in this example 460° F., to reach the desired average bulk solids temperature. It is calculated from FIG. 8 that the desired average bulk solids temperature of 460° F. is not reached until a residence time in the preheat zone of 10 mins.

Thus, residence time is reduced by the present invention from 10 mins. to 6.5 mins. Looked at another way, the grate length in the present example can be reduced by the invention as compared to the above described prior system by 44 ft.

Obviously many modifications and variations of the present invention are possible in light of the above teachings. It is therefore to be understood that within the scope of the appended claims the invention may be practiced otherwise than as specifically described.

What is claimed is:

1. A method for gas treating a bed of solid particles supported on a surface of a grate comprising:

(a) moving the bed of particles in a generally horizontal direction by moving the grate in said direction;

(b) releasing the gas, during step (a), into the bed from the open ends of a plurality of conduits, said open ends being located at a plurality of different distances from the grate surface so that the gas is released at different depths in the bed, wherein distance and depth is measured along lines generally normal to said direction.

2. A method as recited in claim 1, wherein for a particular portion of the bed, gas is released at progressively closer distances to the grate surface as the bed moves in said direction.

3. A method as recited in claim 1, wherein the particles are shale particles.

4. A method as recited in claim 2, wherein said plurality of conduits comprises a plurality of conduit arrays, conduits in a particular array having open ends located at a particular distance from the grate surface so as to be at a particular depth in the bed of particles.

5. A method for gas treating a bed of solid particles comprising:

(a) moving a bed of particles, supported upon a surface of a grate, in a generally horizontal direction by moving the grate in said direction; and (b) releasing gas into the bed of particles during step (a) from a plurality of holes in the sidewall of at least one conduit which has a longitudinal axis generally perpendicular to said direction and which has a lower end positioned above and closely adjacent to said grate surface, wherein for first and second longitudinally separated sections of said conduit, said second section includes a greater number of holes than said first section so as to provide substantially uniform gas flow at all depths in the bed.

6. A method for gas treating a bed of particles comprising:

moving the bed of particles, which are supported upon a surface of a grate, in a generally horizontal direction by moving said grate in said direction; and releasing gas into the bed from a plurality of positions at different depths in the bed, wherein for a particular portion of the bed, gas is released at progressively increasing depths as the bed moves in said generally horizontal direction.

* * * * *